US008886539B2

(12) United States Patent
Chen

(10) Patent No.: US 8,886,539 B2
(45) Date of Patent: Nov. 11, 2014

(54) PROSODY GENERATION USING SYLLABLE-CENTERED POLYNOMIAL REPRESENTATION OF PITCH CONTOURS

(71) Applicant: Chengjun Julian Chen, White Plains, NY (US)

(72) Inventor: Chengjun Julian Chen, White Plains, NY (US)

( * ) Notice: Subject to any disclaimer, the term of this patent is extended or adjusted under 35 U.S.C. 154(b) by 0 days.

(21) Appl. No.: 14/216,611

(22) Filed: Mar. 17, 2014

(65) Prior Publication Data

US 2014/0195242 A1 Jul. 10, 2014

Related U.S. Application Data

(63) Continuation-in-part of application No. 13/692,584, filed on Dec. 3, 2012, now Pat. No. 8,719,030.

(51) Int. Cl.

| | |
|---|---|
| ***G10L 13/06*** | (2013.01) |
| ***G10L 21/00*** | (2013.01) |
| ***G10L 13/00*** | (2006.01) |
| ***G10L 13/02*** | (2013.01) |
| ***G10L 13/033*** | (2013.01) |
| ***G10L 13/10*** | (2013.01) |

(52) U.S. Cl.

CPC ..... *G10L 13/02* (2013.01); *G10L 13/0335* (2013.01); *G10L 13/10* (2013.01)

USPC ..... 704/268; 704/207; 704/258

(58) Field of Classification Search

None

See application file for complete search history.

(56) References Cited

U.S. PATENT DOCUMENTS

| | | | | |
|---|---|---|---|---|
| 5,384,893 | A * | 1/1995 | Hutchins | 704/267 |
| 5,617,507 | A * | 4/1997 | Lee et al. | 704/200 |
| 7,155,390 | B2 * | 12/2006 | Fukada | 704/254 |
| 8,195,463 | B2 * | 6/2012 | Capman et al. | 704/258 |
| 8,494,856 | B2 * | 7/2013 | Latorre et al. | 704/260 |
| 2006/0074678 | A1 * | 4/2006 | Pearson et al. | 704/267 |

OTHER PUBLICATIONS

Levitt and Rabiner, "Analysis of Fundamental Frequency Contours in Speech", The Journal of the Acoustical Society of America, vol. 49, Issue 2B, 1971.*

Hirose, Keikichi, and Hiroya Fujisaki. "Analysis and synthesis of voice fundamental frequency contours of spoken sentences." Acoustics, Speech, and Signal Processing, IEEE International Conference on ICASSP'82.. vol. 7. IEEE, 1982.*

(Continued)

*Primary Examiner* — Brian Albertalli

(57) ABSTRACT

The present invention discloses a parametrical representation of prosody based on polynomial expansion coefficients of the pitch contour near the center of each syllable. The said syllable pitch expansion coefficients are generated from a recorded speech database, read from a number of sentences by a reference speaker. By correlating the stress level and context information of each syllable in the text with the polynomial expansion coefficients of the corresponding spoken syllable, a correlation database is formed. To generate prosody for an input text, stress level and context information of each syllable in the text is identified. The prosody is generated by using the said correlation database to find the best set of pitch parameters for each syllable. By adding to global pitch contours and using interpolation formulas, complete pitch contour for the input text is generated. Duration and intensity profile are generated using a similar procedure.

11 Claims, 6 Drawing Sheets

(56) References Cited

OTHER PUBLICATIONS

Sakai, Shinsuke, and James Glass. "Fundamental frequency modeling for corpus-based speech synthesis based on a statistical learning technique." Automatic Speech Recognition and Understanding, 2003. ASRU'03. 2003 IEEE Workshop on. IEEE, 2003.*

Sakai, Shinsuke. "Additive modeling of english f0 contour for speech synthesis." Proc. ICASSP. vol. 1. 2005.*

Ravuri, Suman, and Daniel PW Ellis. "Stylization of pitch with syllable-based linear segments." Acoustics, Speech and Signal Processing, 2008. ICASSP 2008. IEEE International Conference on. IEEE, 2008.*

Ghosh, Prasanta Kumar, and Shrikanth S. Narayanan. "Pitch contour stylization using an optimal piecewise polynomial approximation." Signal Processing Letters, IEEE 16.9 (2009): 810-813.*

* cited by examiner

| Syllable name | Syllable start time | Voiced start time | Center time | Voiced end time | Syllable end time | Average pitch ($A_n$) | Pitch slope ($B_n$) |
|---|---|---|---|---|---|---|---|
| he | 0.200 | 0.257 | 0.288 | 0.319 | 0.320 | 4.556 | -54.361 |
| moved | 0.320 | 0.326 | 0.460 | 0.595 | 0.640 | 4.045 | -5.688 |
| a- | 0.640 | 0.652 | 0.688 | 0.724 | 0.730 | 1.715 | -20.464 |
| way | 0.730 | 0.732 | 0.849 | 0.966 | 0.970 | 2.256 | -2.893 |
| as | 0.970 | 0.975 | 1.031 | 1.087 | 1.200 | -0.492 | -9.687 |
| qui- | 1.200 | 1.264 | 1.319 | 1.374 | 1.380 | 2.463 | -7.108 |
| et- | 1.380 | 1.382 | 1.437 | 1.492 | 1.550 | 0.918 | -24.600 |
| ly | 1.550 | 1.575 | 1.645 | 1.714 | 1.720 | 0.870 | -22.367 |
| as | 1.720 | 1.723 | 1.759 | 1.796 | 1.890 | 0.605 | 1.703 |
| he | 1.890 | 1.905 | 1.950 | 1.996 | 2.000 | 1.742 | -28.698 |
| had | 2.000 | 2.004 | 2.058 | 2.111 | 2.200 | 0.278 | -1.504 |
| come | 2.200 | 2.272 | 2.387 | 2.502 | 2.520 | -1.780 | -32.487 |

FIG. 4

PROSODY GENERATION USING SYLLABLE-CENTERED POLYNOMIAL REPRESENTATION OF PITCH CONTOURS

The present application is a continuation in part of patent application Ser. No. 13/692,584, entitled "System and Method for Speech Synthesis Using Timbre Vectors", filed Dec. 3, 2012, by inventor Chongjin Julian Chen.

FIELD OF THE INVENTION

The present invention generally relates to speech synthesis, in particular relates to methods and systems for generating prosody in speech synthesis.

BACKGROUND OF THE INVENTION

Speech synthesis, or text-to-speech (TTS), involves the use of a computer-based system to convert a written document into audible speech. A good TTS system should generate natural, or human-like, and highly intelligible speech. In the early years, the rule-based TTS systems, or the formant synthesizers, were used. These systems generate intelligible speech, but the speech sounds robotic, and unnatural.

To generate natural sounding speech, the unit-selection speech synthesis systems were invented. The system requires the recording of large amount of speech. During synthesis, the input text is first converted into phonetic script, segmented into small pieces, and then find the matching pieces from the large pool of recorded speech. Those individual pieces are then stitched together. Obviously, to accommodate arbitrary input text, the speech recording must be gigantic. And it is very difficult to change the speaking style. Therefore, for decades, alternative speech synthesis systems which has the advantages of both formant systems, small and versatile, and the unit-selection systems, naturalness, have been intensively sought.

In a related patent application, a system and method for speech synthesis using timbre vectors are disclosed. The said system and method enable the parameterization of recorded speech signals into a highly amenable format, timbre vectors. From the said timbre vectors, the speech signals can be regenerated with substantial degree of modifications, and the quality is very close the original speech. For speech synthesis, the said modifications include prosody, which comprises the pitch contour, the intensity profile, and durations of each voice segments. However, in the previous application U.S. Ser. No. 13/692,584, no systems and methods for the generation of prosody is disclosed. In the current application, the systems and methods for generating prosody for an input text are disclosed.

SUMMARY OF THE INVENTION

The present invention discloses a parametrical representation of prosody based on polynomial expansion coefficients of the pitch contour near the centers of each syllable, and a parametrical representation of the average global pitch contour for different types of phrases. The pitch contour of the entire phrase or sentence is generated by using a polynomial of higher order to connect the individual polynomial representation of the pitch contour near the center of each syllable smoothly over syllable boundaries. The pitch polynomial expansion coefficients near the center of each syllable are generated from a recorded speech database, read from a number of sentences in text form. A pronunciation and context analysis of the said text is performed. By correlating the said pronunciation and context information with the said polynomial expansion coefficients at each syllable, a correlation database is formed. To generate prosody for an input text, word pronunciation and context analysis is first executed. The prosody is generated by using the said correlation database to find the best set of pitch parameters for each syllable, adding to the corresponding global pitch contour of the phrase type, then use the interpolation formulas to generate the complete pitch contour for the said phrase of input text. Duration and intensity profile are generated using a similar procedure.

One general problem of the prior-art prosody generating systems is that because pitch only exists for voiced frames, the pitch signals for a sentence in recorded speech data is always discontinuous and incomplete. Pitch values do not exist on unvoiced consonants and silence. On the other hand, during the synthesis step, because the unvoiced consonants and silence sections do not need a pitch value, the predicted pitch contour is also discontinuous and incomplete. In the present invention, in order to build a database for pitch contour prediction, only the pitch values at and near the center of each syllable are required. In order to generate the pitch contours for an input text, the first step is to generate the polynomial expansion coefficients at the center of each syllable where pitch exists. Then, the pitch values for the entire sentence is generated by interpolation using a set of mathematical formulas. If the consonants at the ends of a syllable is voiced, such as n, m, z, and so on, the continuation of pitch value is naturally useful. If the consonants at the ends of a syllable is unvoiced, such as s, t, k, the same interpolation procedure is also applied to generate a complete set of pitch marks. Those pitch marks in the time intervals of unvoiced consonants and silence are important for the speech-synthesis method based on timbre vectors, as disclosed in patent application Ser. No. 13/692,584.

A preferred embodiment of the present invention using polynomial expansion at the centers of each syllable is the all-syllable based speech synthesis system. In this system, a complete set of well-articulated syllables in a target language is extracted from a speech recording corpus. Those recorded syllables are parameterized into timbre vectors, then converted into a set of prototype syllables with flat pitch, identical duration, and calibrated intensity at both ends. During speech synthesis, the input text is first converted into a sequence of syllables. The samples of each syllable is extracted from the timbre-vector database of prototype syllables. The prosody parameters are then generated and applied to each syllable using voice transformation with timbre vectors. Each syllable is morphed into a new form according to the continuous prosody parameters, and then stitched together using the timbre fusing method to generate an output speech.

BRIEF DESCRIPTION OF DRAWINGS

FIG. 4 shows an example of the pitch parameters for each syllable of a sentence.

DETAILED DESCRIPTION OF THE INVENTION

Figure 1:
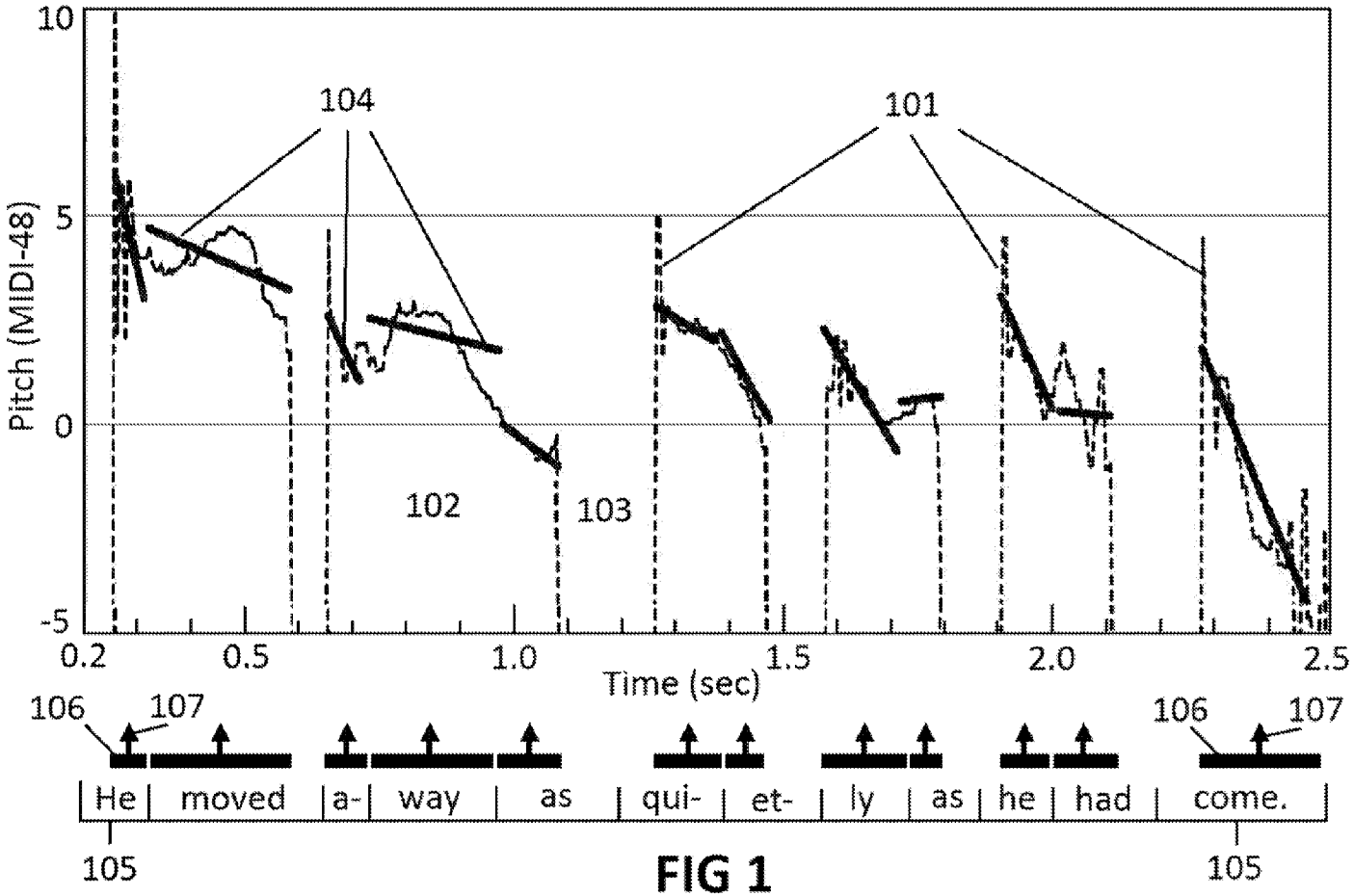
FIG. 1 is an example of the linear zed representation of pitch data on each syllable.
Figure 2:
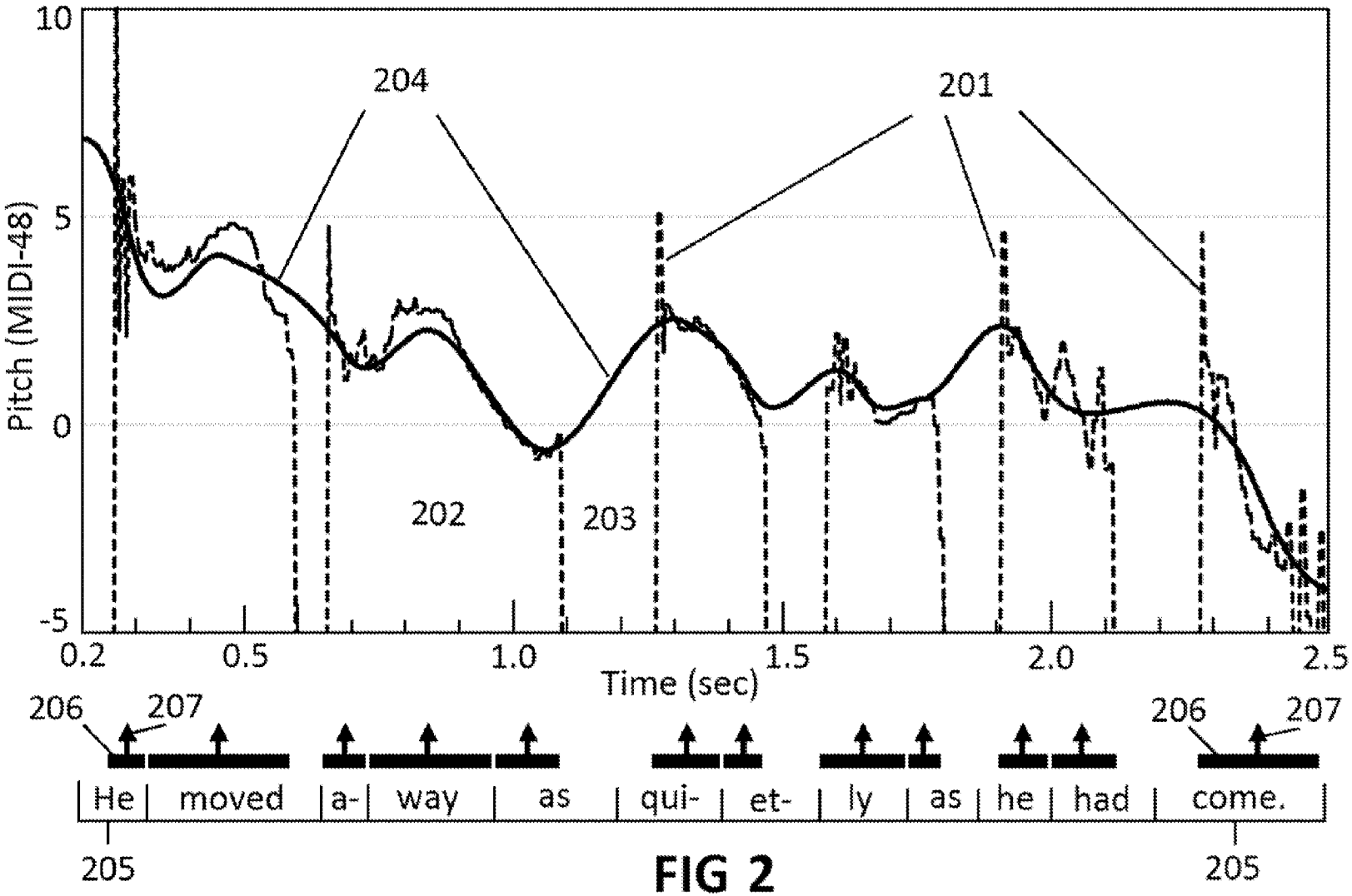
FIG. 2 is an example of the interpolated pitch contour of the entire sentence.
Figure 3:
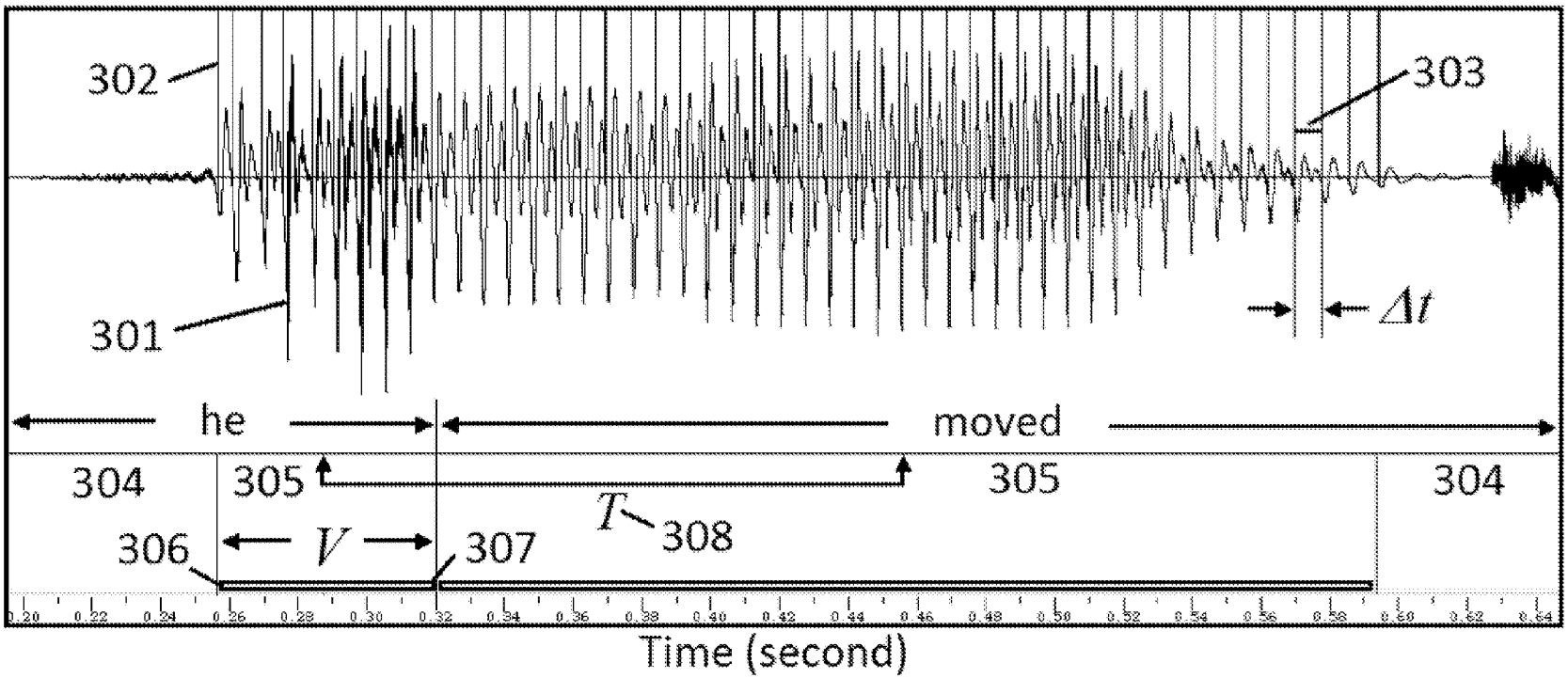
FIG. 3 shows the process of constructing the linear zed pitch contour and the interpolated pitch contour.

FIG. 1, FIG. 2 and FIG. 3 show the concept of polynomial expansion coefficients of the pitch contour near the centers of each syllable, and the pitch contour of the entire phrase or sentence generated by interpolation using a polynomial of higher order. This special parametrical representation of pitch contour distinguishes the present invention from all prior art methods. Shown in FIG. 1 is an example, the sentence "He moved away as quietly as he had come" from the ARCTIC databases, sentence number a0045, spoken by a male U.S. American speaker bdl. The original pitch contour, 101, represented by the dashed curve, is generated by the pitch marks from the electroglottograph (EGG) signals. As shown, pitch marks only exist in the voiced sections of speech, 102. In unvoiced sections 103, there is no pitch marks. In FIG. 1, there are 6 voiced sections, and 6 unvoiced sections.

The sentence can be segmented into 12 syllables, 105. Each syllable has a voiced section, 106. The middle point of the voiced section is the syllable center, 107.

The pitch contour of the said voiced section 106 of a said syllable 105 can be expended into a polynomial, centered at the said syllable center 107. The polynomial coefficients of the said voiced section 106 are obtained using least-squares fitting, for example, by using the Gegenbauer polynomials. This method is well-known in the literature (see for example Abraham and Stegun, Handbook of Mathematical Functions, Dover Publications, New York, Chapter 22, especially pages 790-791). Showing in FIG. 1 a linear approximation, 104, which has two terms, the constant term and the slope (derivative) term. In each said voiced section in each said syllable, the said linear curve 104 approximates the said pitch data with the least squares of error. On the entire sentence, those approximate curves are discontinuous.

FIG. 2 is the same as FIG. 1, but the linear approximation curves are connected together by interpolation to form a continuous curve over the entire sentence, 204. In FIG. 2, 201 is the experimental pitch data. 202 is a voiced section, and 203 is an unvoiced section. At the center of each said syllable, 207, the pitch value and pitch slope of the continuous curve 204 must match those in the individual linear curves, 104. The interpolated pitch curve also includes unvoiced sections, such as 203. Those values can be applied to generate segmentation points for the voiced sections as well as the unvoiced sections, which are important for the execution of speech synthesis using timbre vectors, as in patent application Ser. No. 13/692,584.

FIG. 3 shows the process of extracting parameters from experimental pitch values to form the polynomial approximations, and the process of connecting the said polynomial approximations into a continuous curve. As an example, the first two syllables of the said sentence, number a0045 the ARCTIC databases, "he" and "moved", are shown. In FIG. 3, 301 is the voice signal, 302 are the pitch marks generated from the electroglottograph signals. In regions where electroglottograph signals exist, the pitch period 303 is the time (in seconds) between two adjacent pitch marks, denoted by Δt. The pitch value, in MIDI, is related to Δt by $$p = 69 - \frac{12}{\ln 2}\ln(440\Delta t).$$

The pitch contour on each said voiced section, for example, V between 306 and 307, is approximated by a polynomial using least-squares fitting. In FIG. 1, a linear approximation of the pitch of the n-th syllable as a function of time near the center t=0 is obtained $$p=A_n+B_nt,$$

where $A_n$ and $B_n$ are the syllable pitch parameters. To make a continuous pitch curve over syllable boundaries, a higher-order polynomial is used. Suppose the next syllable center is located at a time T from the center of the first one. Near the center of the (n+1)-th syllable where t=T, the linear approximation of pitch is $$p=A_{n+1}+B_{n+1}(t-T).$$

It can be shown directly that a third-order polynomial can connect them together, to satisfy the linear approximations at both syllable centers, as shown in 308 in FIG. 3, $$p=A_n+B_nt+Ct^2+Dt^3,$$

where the coefficients C and D are calculated using the following formulas:

$$C = \frac{3(A_{n+1} - A_n)}{T^2} + \frac{B_{n+1} - 2B_n}{T},$$

$$D = -\frac{2(A_{n+1} - A_n)}{T^3} + \frac{B_n + B_{n+1}}{T^2}.$$

Therefore, over the entire sentence, the pitch value and pitch slope of the interpolated pitch contour are continuous, as shown in 204 of FIG. 2.

For expressive speech or tone languages such as Mandarin Chinese, the curvature of the pitch contour at the syllable center may also be included. More than one half of world's languages are tone languages, which uses pitch contours of the main vowels in the syllables to distinguish words or their inflections, analogously to consonants and vowels. Examples of tone languages include Mandarin Chinese, Cantonese, Vietnamese, Burmese, That, a number of Nordic languages, and a number of African languages, see for example the book "*Tone*" by Moira Yip, Cambridge University Press, 2002. Near the center of syllable n, the polynomial expansion of the pitch contour includes a quadratic term, $$p=A_n+B_nt+C_nt^2,$$

and near the center of the (n+1)-th syllable, the polynomial expansion of the pitch contour is $$p=A_{n+1}+B_{n+1}(t-T)+C_{n+1}(t-T)^2,$$

wherein the coefficients are obtained using least-squares fit from the voiced section of the (n+1)-th syllable. Similar to the linear approximation, using a higher-order polynomial, a continuous curve to connect the two syllables can be obtained, $$p=A_n+B_nt+C_nt^2+Dt^3+Et^4+Ft^5,$$

where the coefficients D, E and F are calculated using the following formulas:

$$D = \frac{10(A_{n+1} - A_n)}{T^3} - \frac{8B_{n+1} + 6B_n}{T^2} + \frac{C_{n+1} - 3C_n}{T},$$

$$E = -\frac{15(A_{n+1} - A_n)}{T^4} + \frac{7B_{n+1} + 8B_n}{T^3} - \frac{2C_{n+1} - 3C_n}{T^2},$$

$$F = \frac{6(A_{n+1} - A_n)}{T^5} - \frac{3B_{n+1} + 3B_n}{T^4} + \frac{C_{n+1} - C_n}{T^3}.$$

The correctness of those formulas can be verified directly.

FIG. 4 shows an example of the parameters for each syllable of the entire sentence. The entire continuous pitch curve 204 can be generated from the data set. The first column in FIG. 4 is the name of the syllable. The second column is the starting time of the said syllable. The third column is the starting time of the voiced section in the said syllable. The fourth column is the center of the said voiced section, and also the center of the said syllable. The fifth column is the ending time of the voiced section of the said syllable. The sixth column is the ending time of the said syllable. The seventh and the eighth columns are the syllable pitch parameters: The seventh column is the average pitch of the said syllable. The eighth column is the pitch slope, or the time derivative of the pitch, of the said syllable.

As shown in FIG. 1 and FIG. 2, the overall trend of the pitch contour of the said is downwards, because the sentence is a declarative. For interrogative sentences, or a questions, the overall pitch contour is commonly upwards. The entire pitch contour of a sentence can be decomposed into a global pitch contour, which is determined by the type of the sentence; and a number of syllable pitch contours, determined by the word stress and context of the said syllable and the said word. The observed pitch profile is a linear superposition of a number of syllable pitch profiles on a global pitch contour.

Figure 5:
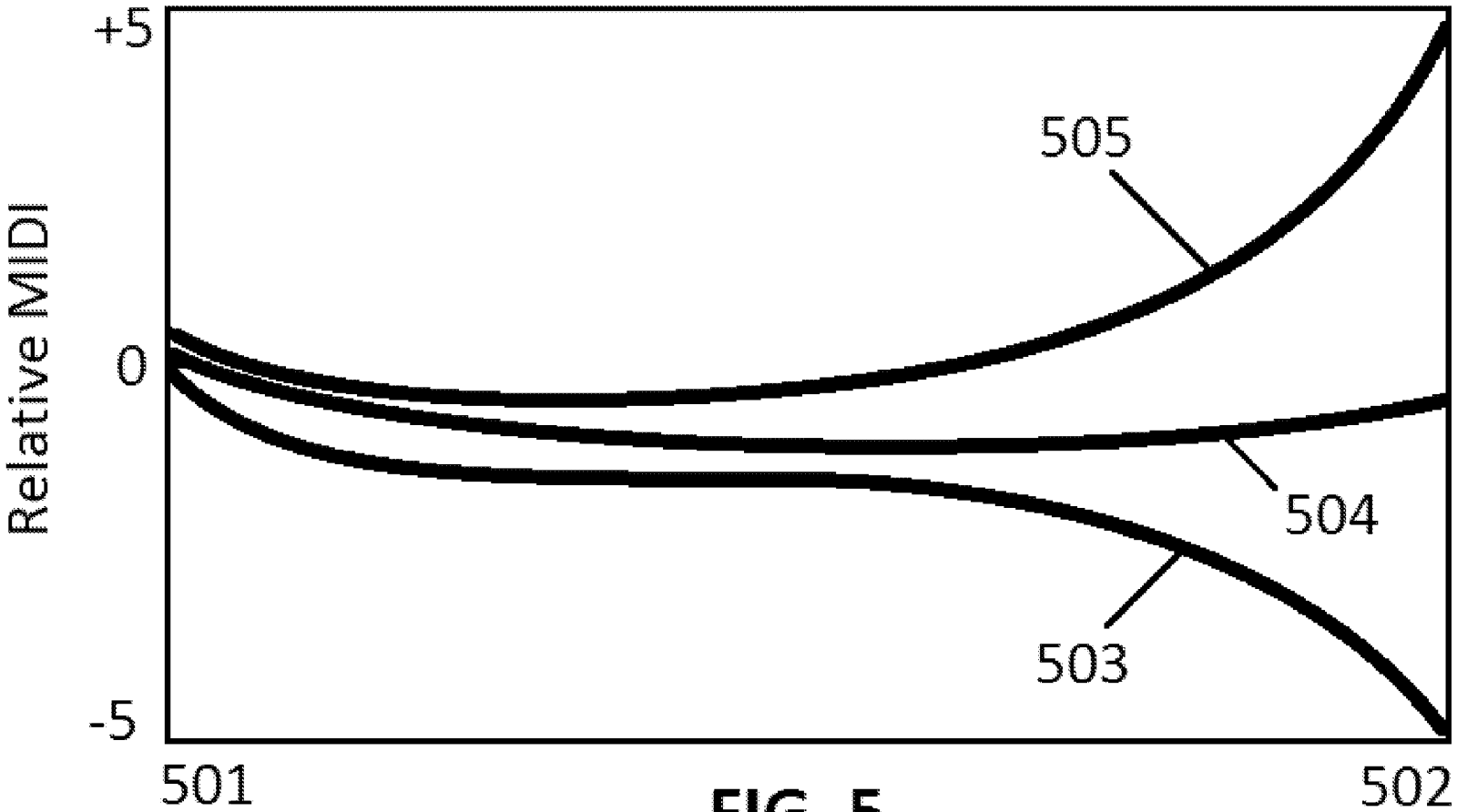
FIG. 5 shows the global pitch contour of three types of sentences and phrases.

FIG. 5 shows examples of the global pitch contours. 501 is the time of the beginning of a sentence or a phrase. 502 is the time of the end of a sentence or a phrase. 503 is the global pitch contour of a typical declarative sentence. 504 is the global pitch contour of a typical intermediate phrase, not an ending phrase in a sentence. 505 is the typical global pitch contour of a interrogative sentence or an ending phrase of a interrogative sentence. Those curves are in general constructed from the constant terms of the polynomial expansions of said syllables from a large corpus of recorded speech, represented by a curve of a few parameters, such as a 4th order polynomials, $$p_g=C_0+C_1t+C_2t^2+C_3t^3+C_4t^4,$$

where $p_g$ is the global pitch contour, and $C_0$ through $C_4$ are the coefficients to be determined by least-squares fitting from the constant terms of the polynomial expansions of said syllables, for example, by using the Gegenbauer polynomials (see for example Abraham and Stegun, Handbook of Mathematical Functions, Dover Publications, New York, Chapter 22, especially pages 790-791).

Figure 6:
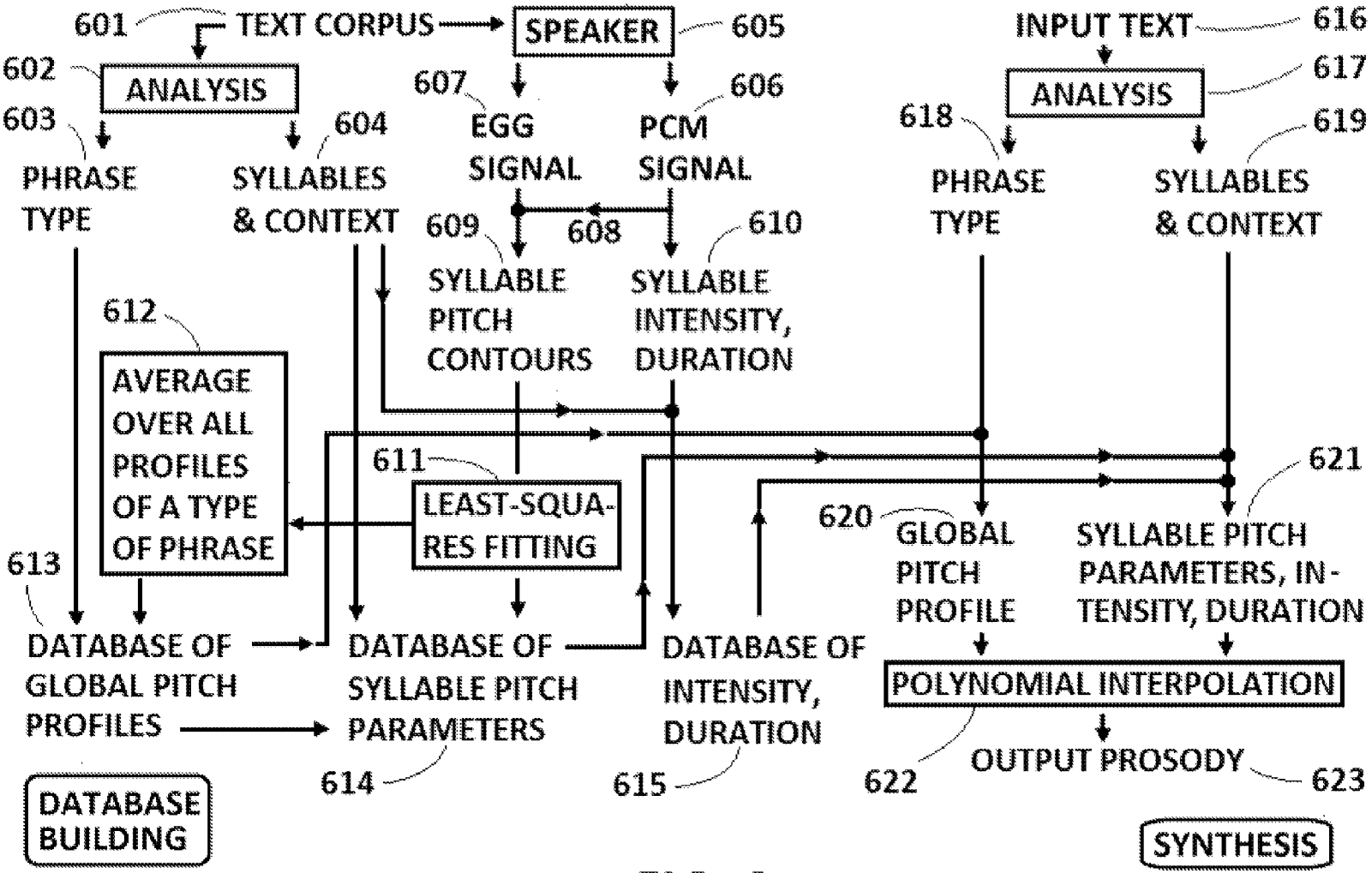
FIG. 6 shows the flow chart of database building and the generation of prosody during speech synthesis.

FIG. 6 shows the process of building a database and the process of generating prosody during speech synthesis. The left-hand side shows the database building process. A text corpus 601 containing all the prosody phenomena of interest is compiled. A text analysis module 602 segments the text into sentences and phrases, identifies the type of each said sentence or said phase of the text, 603. The said types comprise declarative, interrogative, imperative, exclamatory, intermediate phase, etc. Each sentence is then decomposed into syllables. Although automatic segmentation into syllables is possible, human inspection is often needed. The context information of each said syllable 604 is also gathered, comprising the stress level of the said syllable in a word, the emphasis level of the said word in the phrase, the part of speech and the grammatical identification of the said word, and the context of the said word with regard to neighboring words.

Every sentence in the said text corpus is read by a professional speaker 605 as the reference standard for prosody. The voice data through a microphone in the form of pcm (pulse-code modulation) 606. If an electroglottograph instrument is available, the electroglottograph data 607 are simultaneously recorded. Both data are segmented into syllables to match the syllables in the text, 604. Although automatic segmentation of the voice signals into syllables is possible, human inspection is often needed. From the EGG data 607, or combined with the pcm data 606 through a glottal closure instant (GCI) program 608, the pitch contour 609 for each syllable is generated. Pitch is defined as a linear function of the logarithm of frequency or pitch period, preferably in MIDI as in section. Furthermore, from the pcm data 606, the intensity and duration data 610 of each said syllable are identified.

The pitch contour of a pitch period in the voiced section of each said syllable is approximated by a polynomial using least-squares fitting 611. The values of average pitch (the constant term of the polynomial expansion) of all syllables in a sentence or a phrase, are taken to form a polynomial using least-squares fitting. The coefficients are then averaged over all phrases or sentences of the same type in the text corpus to generate a global pitch profile for that type, see FIG. 5 and section. The collection of those averaged coefficients of phrase pitch profiles, correlating to the phrase types, form a database of global pitch profiles 613.

The pitch parameters of each syllable, after subtracting the value of global pitch profile at that time, are correlated with the syllable stress pattern and context information to form a database of syllable pitch parameters 614. The said database will enable the generation of syllable pitch parameters by giving an input information of syllables.

The right-hand side of FIG. 6 shows the process of generating prosody for an input text 616. First, by doing text analysis 617, similar to 602, the phrase type 618 is determined. The type comprises declarative, interrogative, exclamatory, intermediate phase, etc. A corresponding global pitch contour 620 is retrieved from the database 613. Then, for each syllable, the property and context information of the said syllable, 619, is generated, similar to 604. Based on the said information, using the database 614 and 615, the polynomial expansion coefficients of the pitch contour, as well as the intensity and duration of the said syllable, 621, are generated. The global pitch contour 620 is then added to the constant term of each set of syllable pitch parameters. By using polynomial interpolation procedure 622, an output prosody 623 including a continuous pitch contour for the entire sentence or phrase as well as intensity and duration for each syllable, is generated.

Combining with the method of speech synthesis using timbre vectors, U.S. patent application Ser. No. 13/692,584, a syllable-based speech synthesis system can be constructed. For many important languages on the world, the number of phonetically different syllables is finite. For example, Spanish language has 1400 syllables. Because using timbre vector representation, for each syllable, one prototype syllable is sufficient. Syllables of different pitch contour, duration and intensity profile can be generated from the one prototype syllable following the prosody generated, then executing timbre-vector interpolation. Adjacent syllables can be joined together using timbre fusing. Therefore, for any input text, natural sounding speech can be synthesized.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

I claim:

1. A method for building databases for prosody generation in speech synthesis using one or more processors comprising:

A) compile a text corpus of sentences containing all the prosody phenomena of interest;

B) for each phrase in each said sentence, identify the phrase type;

C) segment each sentence into syllables, identify the property and context information of each said syllable;

D) read the sentences by a reference speaker to make a recording of voice signals;

E) segment the voice signals of each sentence into syllables, each said syllable is aligned with a syllable in the text;

F) identify the voiced section in each syllable of the voice recording;

G) calculate pitch values in the said voiced section;

H) generate a polynomial expansion of the pitch contour of each said voiced section in each syllable by least-squares fitting, comprising the use of Gegenbauer polynomials, which at least have a constant term representing the average pitch of the said syllable;

I) for all phrases of a given type, generate a polynomial expansion of the values of said average pitch of all syllables in the said phrases using least-squares fitting, to generate an average global pitch contour of the given phrase type;

J) form a set of syllable pitch parameters for each said syllable by subtracting the value of the global pitch profile at that point from the value of the average pitch of the said syllable together with the rest of polynomial expansion coefficients for the said syllable;

K) correlate the syllable pitch parameters with the property and context information of the said syllable from an analysis of the text to form a database of syllable pitch parameters;

L) correlate the intensity and duration parameters of a syllable to the property and context information of the said syllable from an analysis of the text to form a database of intensity and duration.

2. The pitch values in claim 1 are expressed as a linear function of the logarithm of the pitch period, comprising the use of MIDI unit.

3. The property and context information of the said syllable in claim 1 comprises the stress level of the said syllable in a word, the emphasis level, part of speech, grammatical identity of the said word in the phrase, and the similar information of neighboring syllables and words.

4. For tone languages, the property and context information in claim 1 comprises the tone and stress level of the said syllable in a word, the emphasis level, part of speech, grammatical identity of the said word in the phrase, and the similar information of neighboring syllables and words.

5. The type of phrase in claim 1 comprises declarative, interrogative, exclamatory, or intermediate phrase.

6. A method for generating prosody in speech synthesis from an input sentence using the said databases in claim 1 comprising:

A) for each phrase in the said input sentence, identify the phrase type;

B) segment each sentence into syllables, identify the property and context information of each said syllable;

C) based on the said phrase type, retrieving a global phrase pitch profile from the global pitch profiles database for each said phrase;

D) finding the syllable pitch parameters for each said syllable using the property and context information of each said syllable and the database of syllable pitch parameters;

E) for each said syllable, adding the pitch value in the global pitch contour at the time of the said syllable to the constant term of the said syllable pitch parameters;

F) calculating pitch values for the entire sentence using polynomial interpolation;

G) finding the intensity and duration parameters for each said syllable using the property and context information of each said syllable and the database of intensity and duration parameters;

H) output the said pitch contour and said intensity and duration parameters for the entire sentence as prosody parameters for speech synthesis.

7. The pitch values in claim 6 are expressed as a linear function of the logarithm of the pitch period, comprising the use of MIDI unit.

8. The property and context information in claim 6 comprises the stress level of the said syllable in a word, the emphasis level, part of speech, grammatical identity of the said word in the phrase, and the similar information of neighboring syllables and words.

9. For tone languages, the property and context information in claim 6 comprises the tone and stress level of the said syllable in a word, the emphasis level, part of speech, grammatical identity of the said word in the phrase, and the similar information of neighboring syllables and words.

10. The type of phrase in claim 6 comprises declarative, interrogative, exclamatory, or intermediate phrase.

11. The recording of voice signals in claim 1 includes simultaneous electroglottograph signals, the voiced sections are identified by the existence of the electroglottograph signals, and the pitch values are calculated from the electroglottograph signals.

* * * * *